US006715389B1

(12) United States Patent
Hay

(10) Patent No.: US 6,715,389 B1
(45) Date of Patent: Apr. 6, 2004

(54) CONDIMENT PACKET OPENING APPARATUS

(76) Inventor: Richard W. Hay, 316 S. Custer, Miles City, MT (US) 59301

( * ) Notice: Subject to any disclaimer, the term of this patent is extended or adjusted under 35 U.S.C. 154(b) by 25 days.

(21) Appl. No.: 10/057,675

(22) Filed: Jan. 24, 2002

(51) Int. Cl.[7] ..... B26D 7/02
(52) U.S. Cl. ..... 83/176; 83/459; 83/946
(58) Field of Search ..... 83/19, 946, 459, 83/917, 140, 143, 176, 458, 453, 454, 932; 53/381.2

(56) References Cited

U.S. PATENT DOCUMENTS

| | | | | | |
|---|---|---|---|---|---|
| 3,125,920 A | * | 3/1964 | Smith | 83/454 |
| 3,357,289 A | * | 12/1967 | Thomson | 83/389 |
| 3,910,144 A | * | 10/1975 | Hess | 83/440.1 |
| 4,944,423 A | * | 7/1990 | Clark et al. | 220/574 |
| 5,101,562 A | * | 4/1992 | Horvath et al. | 30/2 |
| 6,116,128 A | * | 9/2000 | Long | 83/39 |

* cited by examiner

*Primary Examiner*—Kenneth E. Peterson
(74) *Attorney, Agent, or Firm*—Shane P. Coleman; Dorsey & Whitney LLP

(57) ABSTRACT

An apparatus is disclosed for opening condiment packets, having a base and a support that define an opening to receive a condiment packet. A cutter subassembly connected to the support is used to cut the packet received in the opening. The cutter subassembly includes an upper body portion that releasably connects to the support, a lower body portion, a rod that extends through the upper and lower body portions, a handle connected to a top end of the rod, a cutter connected to a lower end of the rod, and a spring system that controls movement of the cutter and lower body portion relative to the upper body portion. The spring system causes the lower body portion to contact a received packet before the cutter cuts the packet, so that the contents of the packet can be urged away from the area to be cut before the cutting. In one example, the spring system includes springs having different spring constants to cause the lower body portion strikes the packet first. The spring system may include one or more extension springs connecting the upper and lower body portions and a compression spring connecting the lower body portion to the rod. A stabilizing rod may be used to keep the lower body portion and cutter aligned relative to the opening.

16 Claims, 7 Drawing Sheets

CONDIMENT PACKET OPENING APPARATUS

FIELD OF INVENTION

Figure 1:
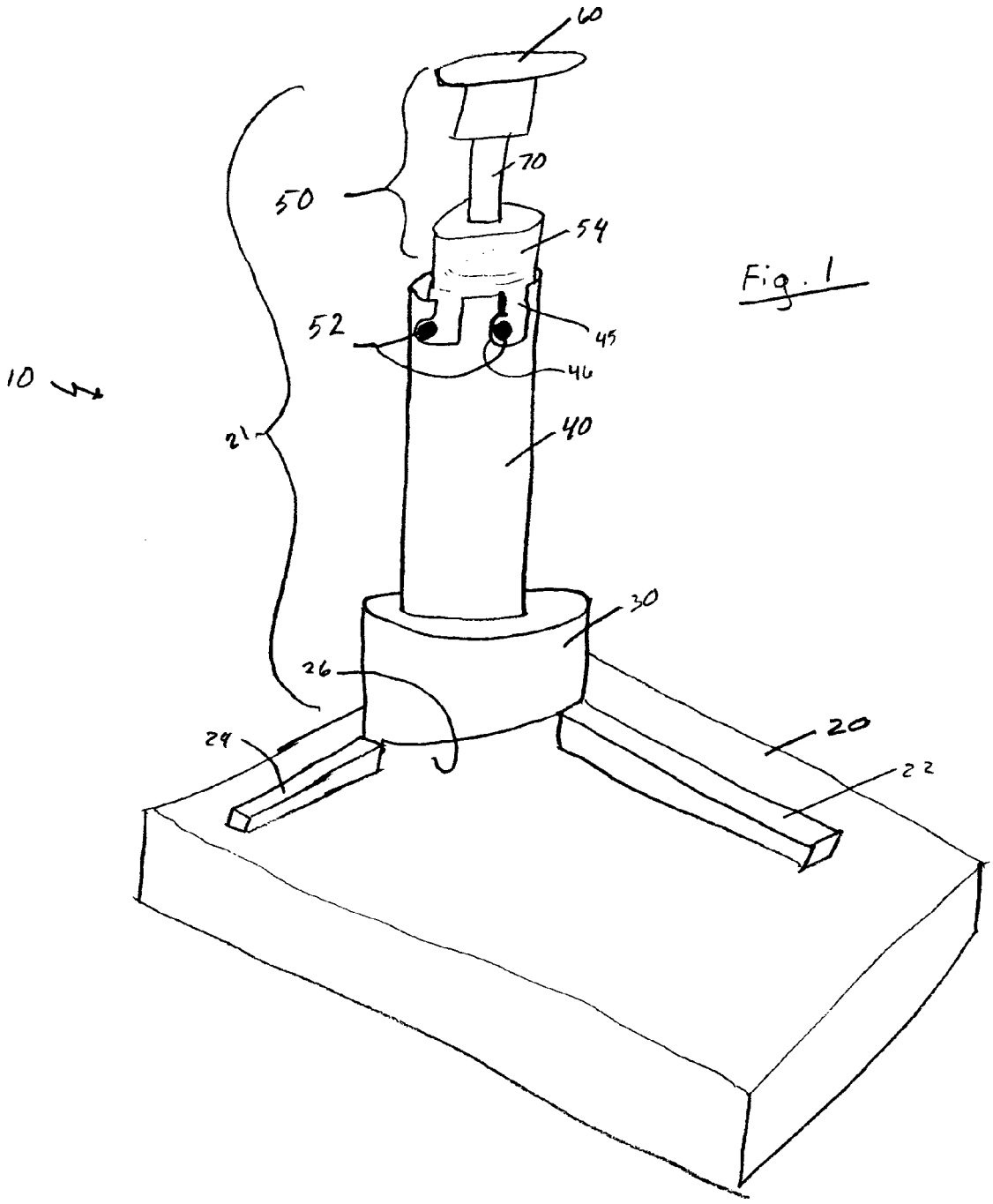

The present invention relates generally to the field of household appliances. More particularly, it relates to apparatuses used to open small packages, such as condiment packets, by cutting or piercing the package.

BACKGROUND

Fast food restaurants, convenience stores, and other vendors often distribute condiments such as ketchup, mustard, mayonnaise, and relish in small, individual serving packets. To open the packets and use the condiments, the user must tear or cut the packet, sometimes along a perforated or weakened score line. Some users, such as small children, elderly individuals, or persons with arthritis, have difficulty tearing these packets open because the packets are so small and require a firm grip and a controlled tearing action to avoid spilling the contents.

One conventional way of opening the packets is to cut them. Some individuals may bring scissors or a knife with them to open the packets. Carrying scissors for this purpose is inconvenient, and causes other problems. The scissors or knife may not be sanitary and may cause the contents of the packet to spill upon opening. It is also not practical for small children who do not know how to use scissors.

Some restaurants dispense condiments using pumps connected to large containers of condiments. Such systems may be more desirable for those users who dine in the restaurant, but are not convenient for those who take their food to go. Also, such systems suffer from sanitary concerns, require frequent cleaning, and may result in excess waste when the condiments are left out all day.

What is needed is a more convenient way of dispensing condiments. In particular, what it needed is a more convenient way of opening condiment packets.

SUMMARY

A condiment packet opening apparatus is disclosed having a base, a support connected to the base, an upper body portion connected to the support, a rod coupled to the upper body portion, and a cutter connected to a lower end of the rod. The base and support define an opening for receiving a condiment packet. When the rod is urged downward, toward the base, the cutter strikes the packet received in the opening so that the contents of the packet may be removed. In one embodiment, a lower body portion is also connected to the rod. The lower body portion contacts the received packet before the cutter and urges the contents of the packet away from the portion of the packet to be cut. The upper body portion may be removably connected to the support. The apparatus may include a stabilizing rod or other means to keep the cutter and lower body portion aligned relative to the opening. One or more springs may be used to restore the cutter to a static position and to cause the lower body portion to contact the packet before the cutter.

An apparatus is also disclosed having a rod connected to a cutter and lower body portion. The apparatus also includes a means for urging the cutter and lower body portion toward a condiment packet, such as a handle on the end of the rod opposite the cutter. The apparatus also includes a means for causing a contact surface of the lower body portion to contact the condiment packet before the cutter contacts the packet.

A method is also disclosed for opening a condiment packet. A portion of a packet is received in an opening of an apparatus. The contents of the packet are urged away from the received portion by a lower body portion of the apparatus. The received portion of the packet is then cut using a cutter-disposed behind the lower body portion.

A method is also disclosed for opening a condiment packet by inserting the packet into an opening in an apparatus. A rod on the apparatus is urged downward toward the packet. A lower body portion of the apparatus is used to cause the contents of the packet to move away from a portion of the packet to be cut. A cutter is then used to cut the packet at the portion away from which contents were moved.

An apparatus is also disclosed for opening condiment packets, having a base and a support that define an opening to receive a packet. A guide on the base is used to direct a condiment packet toward the opening. A cutter subassembly connected to the support is used to cut the packet received in the opening. The cutter subassembly includes an upper body portion that releasably connects to the support, a lower body portion, a rod that extends through the upper and lower body portions, a handle connected to a top end of the rod, a cutter connected to a lower end of the rod, and a spring system that controls movement of the cutter and lower body portion relative to the upper body portion. The spring system causes the lower body portion to contact a received packet before the cutter cuts the packet, so that the contents of the packet can be urged away from the area to be cut before the cutting. In one example, the spring system includes springs having different spring constants to cause the lower body portion strikes the packet first. The spring system may include one or more extension springs connecting the upper and lower body portions and a compression spring connecting the lower body portion to the rod. In one embodiment, a stabilizing rod or other means is used to keep the lower body portion and blade aligned relative to the opening.

SUMMARY OR DRAWINGS

FIG. 1 shows an isometric view of a condiment packet opening apparatus.

Figure 2A:
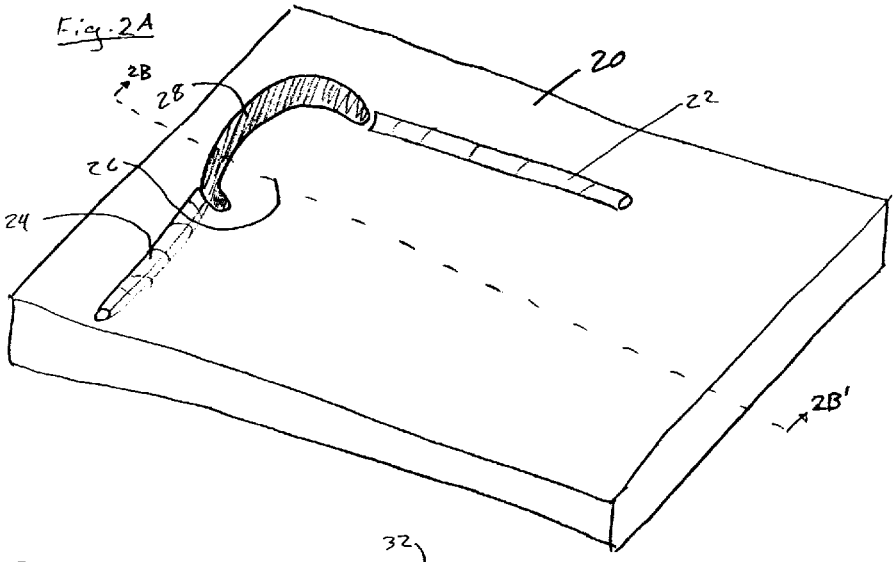
Figure 2B:
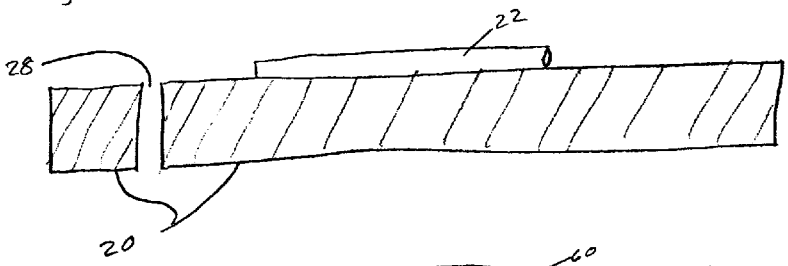

FIGS. 2A–B show more detailed views of the base of the apparatus shown in FIG. 1.

FIGS. 3A–D show more detailed views of a lower support of the apparatus shown in FIG. 1.

Figure 4A:
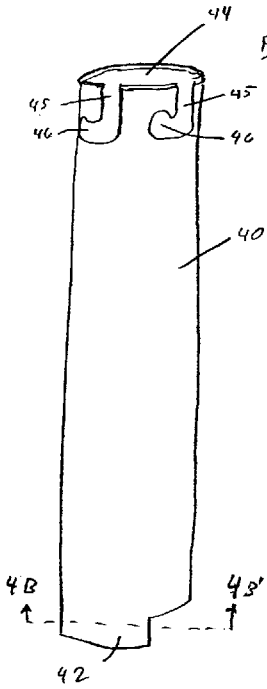
Figure 4B:
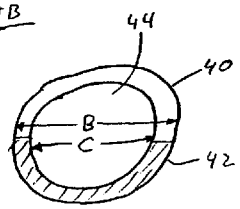

FIGS. 4A–B show more detailed views of an upper support of the apparatus shown in FIG. 1.

FIGS. 5A–D show more detailed views of the cutter subassembly of the apparatus shown in FIG. 1.

Figure 6A:
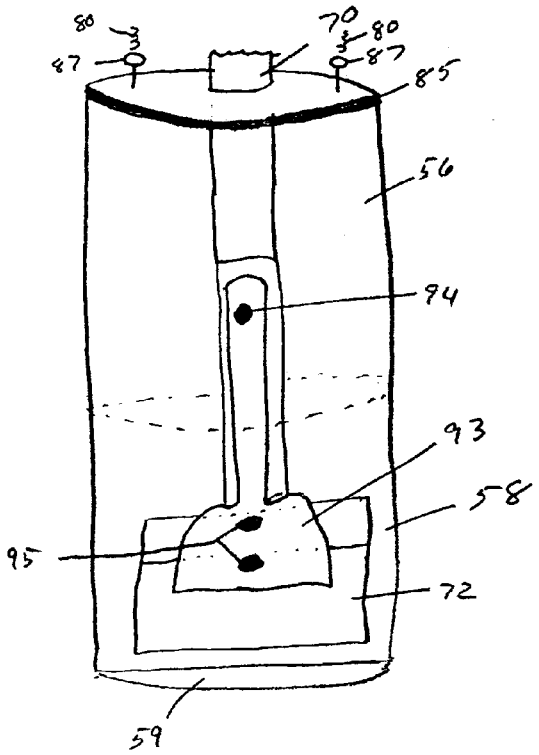
Figure 6B:
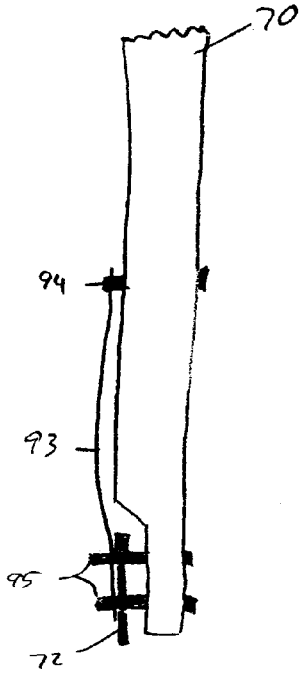

FIGS. 6A–B show more detailed views of a lower portion of the cutter shown in FIG. 1

Figure 5A:
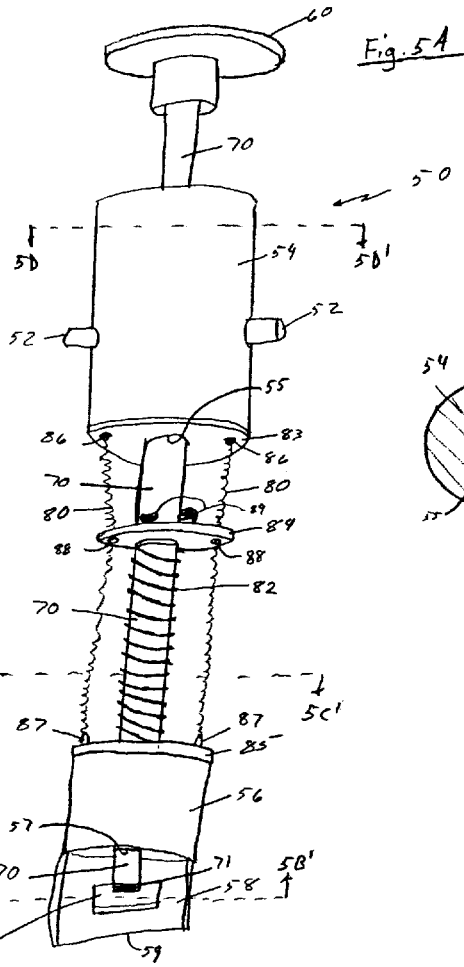
Figure 7:
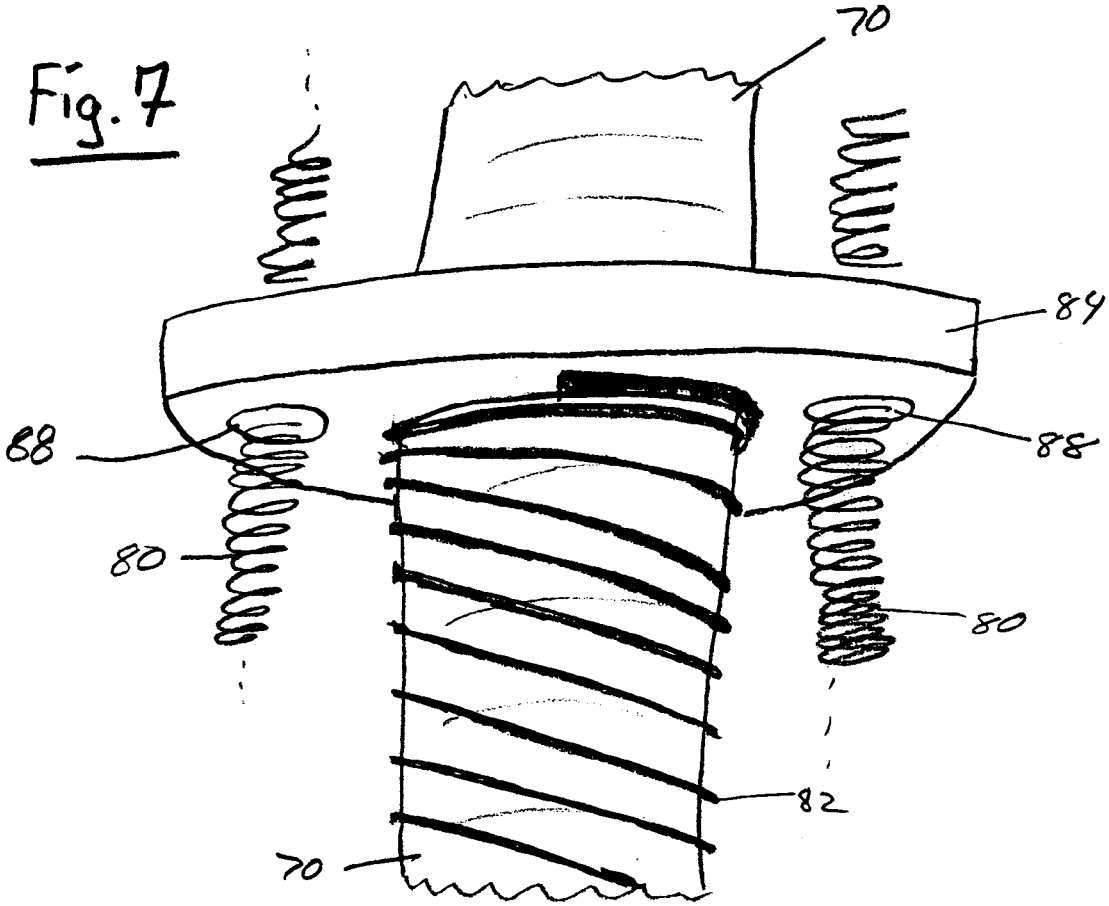

FIG. 7 shows a more detailed view of the connection between the springs shown in FIG. 5A.

Figure 8A:
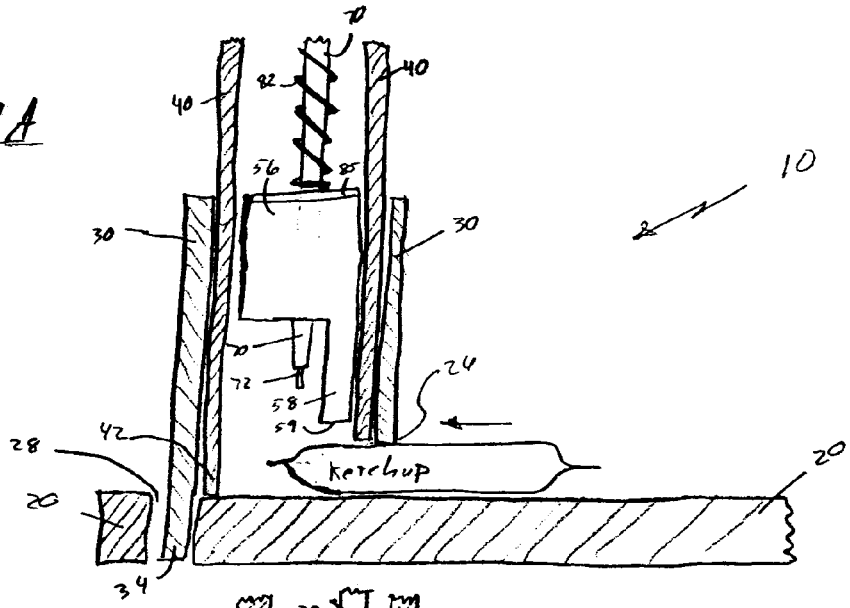
Figure 8B:
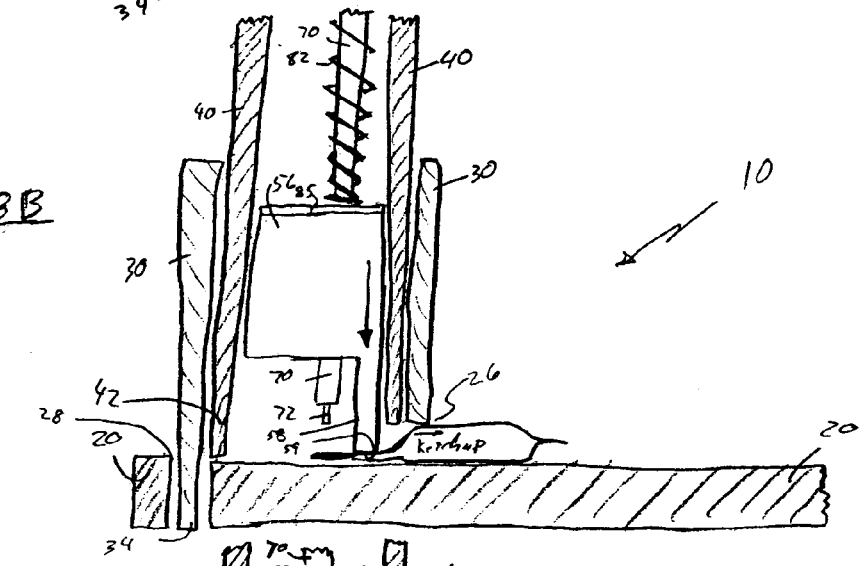
Figure 8C:
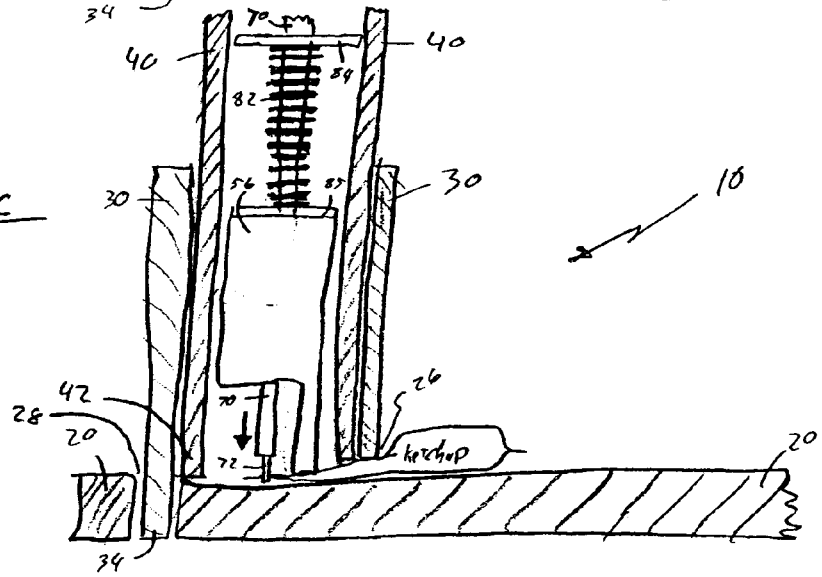

FIGS. 8A–C show the operation of a lower body portion and a cutter in use with a condiment packet.

Figure 9A:
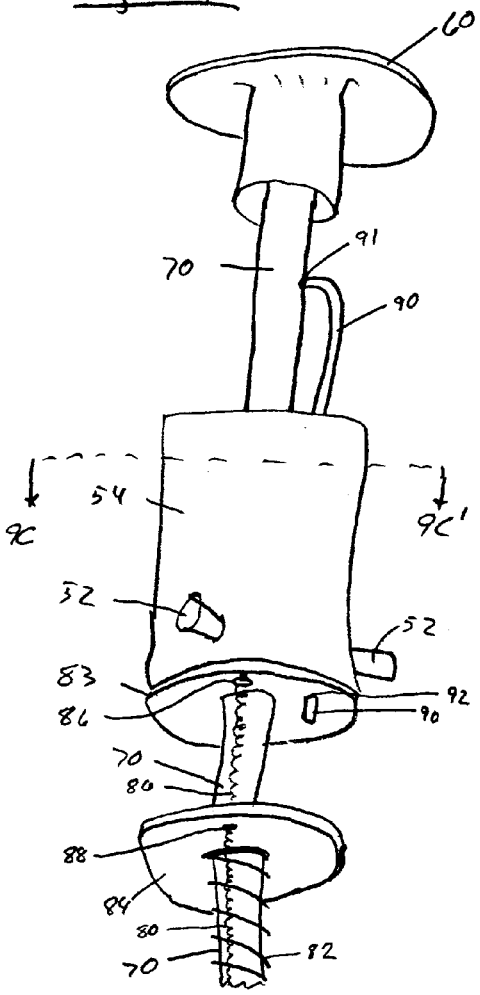
Figure 9B:
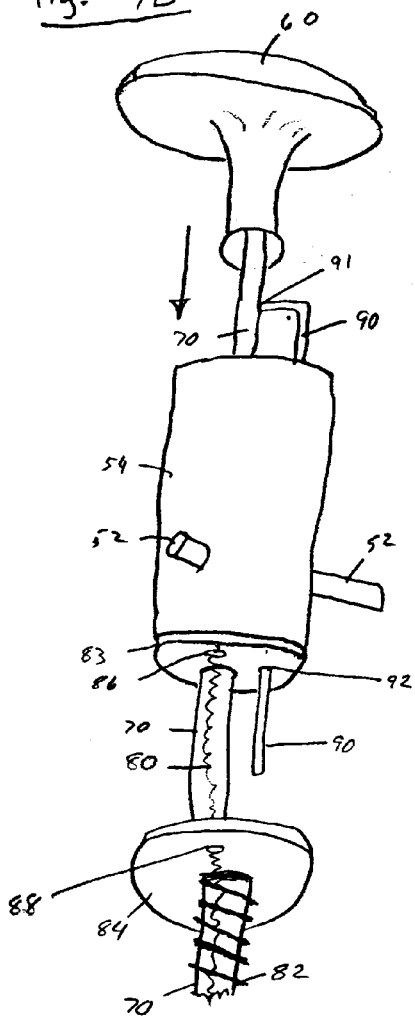
Figure 9C:
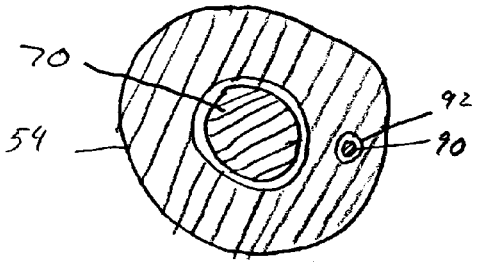

FIGS. 9A–C show a portion of a cutter subassembly having a stabilizing rod.

DETAILED DESCRIPTION

FIG. 1 shows an apparatus 10 having a base 20 and cutting assembly 21. In one embodiment, the base 20 may be formed from a plastic material and may have approximate dimensions of three inches by five inches. The cutting assembly 21 includes a support including a lower support 30 connected to the base 20 and an upper support 40. In one embodiment, the cutting assembly 21 may be approximately eight to twelve inches tall. The lower and upper supports 30, 40 are hollow and support a cutter subassembly 50 that moves relative to the lower and upper supports 30, 40. In the example shown in FIG. 1, the lower and upper supports 30, 40 are generally cylindrical, with the lower support 30 having a greater diameter than the upper support 40, and the cutter subassembly 50 is also generally cylindrical and coaxial with the lower and upper supports 30, 40. In one embodiment, the lower and upper supports 30, 40 may be formed from a plastic or metal tubing, such as polyvinyl chloride (PVC) tubing.

The cutter subassembly 50 includes a handle 60 connected to a rod 70, which is connected in turn to a upper body portion 54. The rod 70 is slidably connected to the upper body portion 54, whereby the rod 70 moves relative to the upper body portion 54 along a central axis. Springs (not shown) or other devices urge the rod 70 to a static position relative to the upper body portion 54. In the example of FIG. 1, the upper body portion 54 is generally cylindrical and has an outside diameter slightly less than the inside diameter of the upper support 40. This allows the upper body portion 54 to fit snugly in the inside of the upper body portion 40, while permitting the upper body portion 54 to slide relative to the upper support 40. In the example shown in FIG. 1, the upper body portion 54 is removably connected to the upper support 40 with connecting members 52 that engage openings 45 in the upper support 40 and slide into a locked position 46 of the opening 46.

The bottom portion of the lower support 30 defines an opening 26 adjacent to the base 20. In use, condiment packets or similar items are inserted into the opening 26. The rod 70 is urged downward, toward the base 20 by exerting a pressure on the handle 60. A cutter (not shown) is connected to the lower end of the rod 70 and cuts the condiment packet. A lower body portion (not shown) is also connected to the lower end of the rod 70 and contacts the condiment packet before the cutter cuts the packet. In one embodiment, the lower body portion squeezes the contents of the packet away from the portion of the packet to be cut, holds the contents of the packet back while the cutter cuts the packet, and shields the cutter from the opening 26 to avoid injury to the user. The base 20 has two guides 22, 24 that direct a condiment packet toward the opening 26.

FIG. 2A shows a more detailed diagram of the base 20 shown in FIG. 1. In the embodiment shown, the base 20 is rectangular and has two generally perpendicular guides 22, 24 rigidly connected thereto. The base 20 in this example defines an opening 28 for connecting to the lower support 30. In this example, the opening 28 is curved for receiving a portion of a curved cylinder in the base 20. FIG. 2B shows a cross-section of the base 20 shown in FIG. 2A taken along the line 2B–2B'. In the example of FIGS. 2A–B, the opening 28 passes through the base 20. Other embodiments may use an opening 28 that passes only partly through the base 20, or may include another means of connecting the base 20 to the cutting assembly 21. In one example, the lower support 30 may be easily removed from the base 20 for cleaning.

Figure 3A:
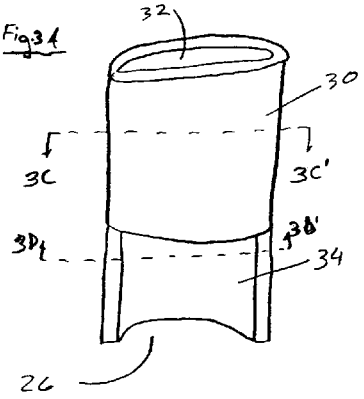
Figure 3B:
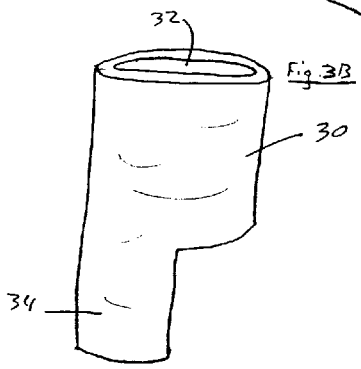
Figure 3C:
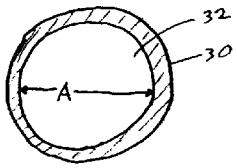
Figure 3D:
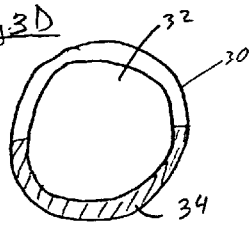

FIGS. 3A–D show views of a lower support 30. FIG. 3D is an isometric view of the front of the lower support 30. In this example, the lower support 30 is generally cylindrical with a top opening 32 and a lower flange 34 that connects to the base 20 at the base opening 28. The lower support 30 in this example is shaped like a PVC pipe having approximately half of the circumference cut away at one end to form the flange 34. FIG. 3B is an isometric view of a side of the lower support 30. FIG. 3C shows a cross-section of the lower support 30 shown in FIG. 3A along the line 3C–3C'. As shown in FIG. 3D, the lower support 30 has an inside diameter A. FIG. 3D shows a cross-section of the lower support 30 shown in FIG. 3A along the line 3D–3D'.

FIG. 4A shows an isometric view of an upper support 40. In the example of FIG. 4A, the upper support 40 includes an opening 44 that receives the cutter subassembly 50. Openings 45 with locking positions 46 are located at the top sides of the upper support 40. In the example of FIG. 4A, the lower end of the upper support 40 includes a flange 42. FIG. 4B shows a cross-section of the upper support 40 shown in FIG. 4A taken along the line 4B–4B'. The upper support 40 is hollow and defines an opening 44. The upper support 40 has an inside diameter B and an outside diameter C.

FIGS. 5A–D show a cutter subassembly 50. FIG. 5A is an isometric view of a cutter subassembly 50 including a handle 60, a rod 70, an upper body portion 54, and a lower body portion 56. The lower end of the rod 70 is attached to a cutter 72 at a connection 71. As used herein, a "cutter" refers to any device capable of making an opening in a plastic or metal packet. In one example, the cutter 72 may be a small razor blade. The connection 71 may be a removable connection 71 that allows the cutter 72 to be easily removed from the rod 70, for example, to clean or change the cutter 72. The lower body portion 56 includes a flange 58 that contacts the condiment packet before the cutter 72 cuts the packet. Connecting members 52 protrude from the upper body portion 54 to engage respective openings 45 in the upper support 40. The rod 70 passes through openings 55, 57 in the upper and lower body portions 54, 56 and is generally coaxial with the upper and lower body portions 54, 56.

In the embodiment shown, the upper and lower body portions 54, 56 are connected to each other by springs 80, 82 that allow the rod 70 and the upper and lower body portions 54, 56 to move relative to each other at desired times. Specifically, the springs 80, 82 allow the flange 58 of the lower body portion 56 to contact the condiment packet before the cutter 72 contacts the packet. This allows the flange 58 to squeeze the contents of the packet away from the portion of the packet to be cut, so that the contents do not spray out when cut. The flange 58 may also hold the contents back while the cutter 72 cuts the packet. The flange 58 may also serve to hold the packet in place so that it does not move while the cutter 72 is moved toward it. The flange 58 may also serve as a guard to protect the user's fingers from being exposed to the cutter 72 when it is lowered. The flange 58 has a contact surface 59 that contacts the packet in use.

In the embodiment shown, washers 83, 85 are connected to the upper and lower body portions 54, 56, respectively. Tension springs 80 connect to the upper and lower body portions 54, 56 at connecting points 86, 87 on the washers 83, 85. The tension springs 80 urge the upper and lower body portions 54, 56 back toward each other in a static position when the handle 60 is depressed by a user. A middle washer 84 is positioned around the rod 70 between the upper and lower body portions 54, 56. One or more connectors 89 connect the middle washer 84 to the rod 70. The tension springs 80 pass through the middle washer 84 at holes 88. A compression spring 82 is positioned around the rod 70 between the middle washer 84 and the lower body portion 56. In one embodiment, the compression spring 82 has sufficient compression that, when the handle 60 is initially depressed, the compression spring 82 does not significantly compress, but instead urges the lower body portion 56 downward as the rod 70' moves downward before contacting the packet. In this embodiment, the spring constant is greater for the compression spring 82 than for the tension springs 80. When the flange 58 of the lower body portion 56 presses the packet against the base 20, the compression spring 82 compresses causing the rod 70 and the cutter 72 to continue moving toward the base 20. At this point, the rod 70 and the cutter 72 move relative to the lower body portion 56. In one embodiment, when the handle 60 is released, the compression spring 82 reaches a static position before the tension springs 80 reach a static position.

In use, the rod 70 slides relative to the upper and lower body portions 54, 56. The upper body portion 54 is fixed relative to the upper support 40 by the connecting members 52 engaging the openings 45 in the locked positions 46. As the handle 60 is depressed, the rod 70 and the lower body portion 56 move relative to the upper body portion 54 until the flange 58 of the lower body portion 56 strikes the condiment packet, pressing it against the base 20. The lower body portion 56 stops moving when it presses the packet against the base 20, but the rod 70 continues to move relative to the upper body portion 54, and begins to move relative to the lower body portion 56 until the cutter 72 contacts the packet and the base 20. After the packet is cut, the user releases the pressure on the handle 60, causing the rod 70 and lower body portion 56 to return to their static positions.

Figure 5D:
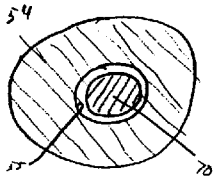
Figure 5B:
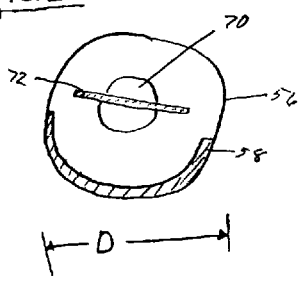

FIG. 5B shows a cross-section of the cutter subassembly 50 of FIG. 5A taken along the line 5B–5B'. In this embodiment, the cutter 72 is a small razor blade removably connected to the lower end of the rod 70. The lower body portion 56 has diameter D, which is slightly less than the inside diameter (C in FIG. 4B) of the upper support 40 in one embodiment.

Figure 5C:
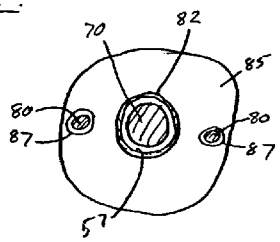

FIG. 5C shows a cross-section of the cutter subassembly 50 of FIG. 5A taken along the line 5C–5C'. As shown, the tension springs 80 connect to the lower body portion 56 at connectors 87. The rod 70 passes through aperture 57, and the compression spring 82 wraps around the rod 70 and abuts the washer 85.

FIG. 5D shows a cross-section of the cutter subassembly 50 of FIG. 5D taken along the line 5D–5D'. The rod 70 passes through aperture 55 in the upper body portion 54.

FIG. 6A shows a front view of one embodiment of a lower end of a rod 70, at which a cutter 72 is connected. In the example shown in FIG. 6A, the cutter 72 is a razor blade 72 connected to the rod 70 with releasable connectors 95. A flat spring 93 is used to hold the blade 72 in place. The flat spring 93 is fixedly connected to the rod 70 by a top connector 94 and exerts a force on the blade 72 toward the rod 70 to keep the blade 72 on the connectors 95. To replace the blade 72 in this embodiment, the user deflects the lower end of the flat spring 93 outward, away from the rod 70, removes the old blade 72 from the connectors 95, places a new blade 72 on the connectors 95, and releases the flat spring 93 back to position where it exerts a force on the new blade 72. As shown in FIG. 6A, when the apparatus 10 is in a static position, the contact surface 59 extends beneath the blade 72 in this embodiment. FIG. 6B shows a side view of the end of the rod 70 shown in FIG. 6A.

FIG. 7 shows a more detailed view of the area around the middle washer 84 of the example device shown in FIG. 5A. The tension springs 80 pass through holes 88 in the middle washer 84 and the rod 70 passes through the middle of the middle washer 84. A compression spring 82 wraps around the rod 70 abuts the middle washer 84. One or more connectors (89 in FIG. 5A) hold the middle washer 84 next to the compression spring 82.

FIGS. 8A–C show a cutaway view of one embodiment of a condiment cutting apparatus 10 in use. As shown, the flange 34 of the lower support 30 is received by the opening 28 in the base 20. The flange 42 of the upper support 40 contacts the base 20 to prevent spilled condiments from leaking into the opening 28.

In FIG. 8A, the cutter subassembly 50 is in a static state, before the handle 60 has been depressed. The tension springs (not shown) are in retracted states and the compression spring 70 is in an extended state as indicated. In this embodiment, the flange 58 on the lower body portion 56 extends lower than the cutter 72 in the static position. A ketchup packet has been inserted into the opening 26 of the apparatus 10. A portion of the packet extends underneath the lower support 30, the upper support 40, the contact surface 59 of the flange 58, and the cutter 72. The shape of the packet indicates that the contents are distributed throughout the packet at this time.

In FIG. 8B, the handle (not shown) has been pushed downward causing the rod 70 to move toward the base 20 as indicated by the arrow. The tension springs (not shown) are now extended as the rod 70 has moved relative to the upper body portion (not shown). The compression spring 82 has not yet significantly compressed because it has sufficient compression to remain substantially extended until the flange 58 of the lower body portion 56 strikes the packet pressing it against the base 20. The contact surface 59 of the flange 58 has contacted the packet causing the contents to move away from the area to be cut by the cutter 72, toward the far end of the packet. This allows the cutter 72 to later cut the packet without cutting into the contents, thereby spilling the contents on the apparatus 10. In one embodiment, the flange 58 substantially covers the opening 26, thereby preventing any condiment contents from spraying out of the opening 26 and preventing a user's fingers from coming into contact with the cutter 72 when in use.

In FIG. 8C, the handle (not shown) is further depressed causing the rod 70 to move further toward the base 20. Because the flange 58 has contacted the base 20, the rod 70 and cutter 72 have moved relative to the lower body portion 56. The compression spring 82 has compressed as indicated, and the cutter 72 has contacted the packet at a point from which the contents have been pushed away by the flange 58. After the cut is made in the packet, the handle 60 is released, the springs 80, 82 return to their static state, and the packet may be removed from the opening 26. To use the condiment; the user may simply squeeze the packet, urging the contents out of the opening created by the cutter.

One embodiment of the apparatus 10 ensures that the cutter 72 and the lower body portion 56 remain aligned relative to the opening 26. This ensures that the contact surface 59 contacts the packet and prevents the user from contacting the cutter 72. FIGS. 9A–C show one example of this embodiment in which the rod 70 is not permitted to significantly rotate relative to the upper body portion 54. A stabilizing rod 90 is rigidly connected to the rod 70 at a point 91 near the handle 60. The stabilizing rod 90 passes through an aperture 92 in the upper body portion 54, and extends through the washer 83. As shown in FIG. 9B, as the handle 60 and rod 70 are pushed relative to the upper body portion 54, the stabilizing rod 90 slides through the opening 92. In one embodiment, the connecting members 52 and their respective openings 45 in the upper support 40 are positioned such that the cutter 72 and the contact surface 59 must be aligned with the opening 26. One skilled in the art will recognize that various means may be used to keep the cutter 72 and contact surface 59 aligned with the opening 26, including but now limited to using a rod 70 having a non-round cross-section or using guides near the opening 26 to align the cutter 72 and/or contact surface 59 as they are moved toward the opening 26 in use.

Although the present invention has been described with respect to particular embodiments thereof, variations are possible. The present invention may be embodied in specific forms without departing from the essential spirit or attributes thereof. For example, the invention may include electric, electronic, pneumatic or hydraulic controls, or it may be operated manually. It is desired that the embodiments described herein be considered in all respects illustrative and not restrictive and that reference be made to the appended claims and their equivalents for determining the scope of the invention.

I claim:

1. An apparatus for opening condiment packets, comprising:

a base;

a support connected to the base, wherein the support and the base define an opening adapted to receive a condiment packet;

an upper body portion connected to the support;

a rod slidably coupled to the upper body portion and having a lower end that is adapted to hold a cutter; and a lower body portion comprising a flange, wherein the lower body portion is connected to the rod and to the upper body portion by a spring system, the spring system comprising a compression spring and an extension spring having different spring constants, wherein the flange contacts the packet received in the opening when the rod is urged toward the base.

2. The apparatus of claim 1, further comprising a cutter connected to the rod, wherein when the rod is moved toward the base, the spring system causes the flange to contact the received packet before the cutter contacts the packet.

3. The apparatus of claim 1, wherein the flange is disposed generally in front of the rod, and wherein the flange substantially covers the opening when the flange contacts the packet.

4. The apparatus of claim 3, further comprising means for aligning the cutter and the flange of the lower body portion relative to the opening.

5. The apparatus of claim 1, wherein the upper body portion removably connects to the support.

6. The apparatus of claim 1, wherein the base comprises one or more guides extending toward the opening.

7. The apparatus of claim 1, wherein the compression spring connects the lower body portion to a fixed point along the rod between the upper and lower body portions, and wherein the extension spring connects the lower body portion to the upper body portion, and wherein the spring constant of the compression spring is greater than the spring constant of the extension spring.

8. The apparatus of claim 1, wherein the support is removably connected to the base and is adapted for holding the rod substantially perpendicular to a top surface of the base.

9. An apparatus comprising:

a rod;

a cutter connected to the rod, the cutter being adapted to cut an opening in a condiment packet;

an upper body portion adapted to connect to a support;

a lower body portion connected to the rod, including a contact surface adapted to contact a condiment packet and urge contents of the packet away from a portion of the packet to be cut; and means for causing the contact surface to contact the condiment packet before the cutter contacts the packet, the means comprising:

an extension spring connected between the upper body portion and the lower body portion, and a compression spring connected between the lower body portion and a point on the rod.

10. The apparatus of claim 9, further comprising a stop connected to the rod at the point, wherein the stop contacts an end of the compression spring.

11. The apparatus of claim 9, further comprising a cylindrical support that connects to the upper body portion, wherein the support substantially encloses the lower body portion in a static position.

12. The apparatus of claim 9, wherein the lower body portion includes a flange disposed adjacent the cutter, an end of which flange forms the contact surface.

13. An apparatus comprising:

a base;

a support connected to the base and defining an opening adjacent the base, the opening being adapted to receive a condiment packet; and a cutter subassembly comprising:

an upper body portion releasably connected to an upper portion of the support;

a lower body portion including a contact surface adapted for contacting the packet received in the opening and urging contents of the packet away from the openings a rod extending through the upper and lower body portions;

a cutter connected to a bottom end of the rod; and a spring system controlling movement of the rod relative to the upper and lower body portions, wherein the spring system causes the contact surface to contact the packet received in the opening before the cutter contacts the packet, wherein the spring system comprises:

an extension spring extending from the upper body portion to tie lower body portion; and a compression spring connected between the lower body portion and a point on the rod between the upper and lower body portions.

14. The apparatus of claim 13, wherein the compression spring has a spring constant greater than a spring constant of the extension spring.

15. The apparatus of claim 13, wherein the cutter is releasably connected to the rod.

16. The apparatus of claim 13, further comprising means for aligning the contact surface with the opening, whereby the lower body portion enters the opening in front of the cutter.

* * * * *